United States Patent [19]

Tobin

[11] 4,253,081

[45] Feb. 24, 1981

[54] EXCESSIVE OVERCURRENT DISABLING MECHANISM FOR A CIRCUIT INTERRUPTING DEVICE

[75] Inventor: Thomas J. Tobin, Northbrook, Ill.

[73] Assignee: S & C Electric Company, Chicago, Ill.

[21] Appl. No.: 26,848

[22] Filed: Apr. 4, 1979

[51] Int. Cl.[3] ..... H01H 85/38

[52] U.S. Cl. ..... 337/222; 200/148 A; 337/275

[58] Field of Search ..... 337/97, 222, 253, 275; 361/109; 335/156; 200/148 A

[56] References Cited

U.S. PATENT DOCUMENTS

| | | | |
|---|---|---|---|
| 1,889,213 | 11/1932 | Nordhem | 337/275 |
| 4,030,055 | 6/1977 | Kotos | 335/16 |
| 4,053,727 | 10/1977 | Kriechbaum | 200/148 A |
| 4,193,053 | 3/1980 | Biller et al. | 337/275 |

*Primary Examiner*—William H. Beha, Jr.
*Attorney, Agent, or Firm*—John D. Kaufmann

[57] ABSTRACT

Disclosed is a mechanism for preventing the operation of a circuit interrupting device during the occurrence of excessive overcurrent. The circuit interrupting device includes an insulative housing having circuit-connectable opposed terminals thereon. Included within the housing is an arcing rod which is electrically connected to one terminal and which, in response to an overcurrent, moves away from a stationary contact electrically connected to the other terminal. Arcing rod movement elongates an arc formed between the arcing rod and the contact in an arc extinguishing environment to extinguish the arc and interrupt the circuit. The mechanism of the invention includes a shoulder on the arcing rod and one or more magnetic yokes positioned adjacent, but normally out of contact with, the shoulder. When an overcurrent through the device occurs which exceeds the device's rating, flux generated by current flow through the arcing rod moves the yoke to engage the shoulder thus preventing arcing rod movement. The yoke may be normally biased away from the shoulder by one or more springs.

30 Claims, 5 Drawing Figures

EXCESSIVE OVERCURRENT DISABLING MECHANISM FOR A CIRCUIT INTERRUPTING DEVICE

BACKGROUND OF THE INVENTION

1. Field of the Invention

This invention relates to a mechanism for preventing the operation of a circuit interrupting device during the time that an excessive overcurrent flows therethrough, and, more particularly, to a ferromagnetic mechanism, operated by flux generated by the excessive overcurrent, for preventing movement of a movable contact thereof during the occurrence of excessive overcurrents which exceed the interrupting device's interrupting rating.

2. Prior Art

Many types of circuit interrupting devices are well known in the art. Such devices include fuses or fuse-like devices, circuit switchers or similar devices, and circuit breakers. Generally speaking, these devices have several common features. Specifically, most circuit interrupting devices typically include an insulative housing with opposed circuit-connectable terminals thereon. Within the housing is usually contained a movable contact, often called an "arcing rod," and a stationary contact. During circuit interruption the movable contact or arcing rod is moved away from the stationary contact to elongate an arc formed therebetween. Arc elongation usually takes place in the vicinity of an arc extintuishing medium, which may be a solid material such as boric acid or a fluid such as sulfur hexafluoride. Arc elongation plus the action of the arc extinguishing medium ultimately result in extinguishment of the arc at a current zero to interrupt the circuit.

Prior art circuit interrupting devices generally have at least two significant electrical ratings. The first significant rating is the continuous or normal current-carrying rating or capability of the device; the second is the current interrupting rating or capability of the device. Again, generally speaking, should the device be called on to interrupt a current in excess of its interrupting rating, undesirable consequences may follow. For example, the device may violently explode, burn or melt.

Specific differences between the various types of circuit interrupting devices usually involve their manner of sensing overcurrents, the manner in which the moving contact or arcing rod is moved away from the stationary contact and the type of arc-extinguishing medium used. In fuses, or fuse-like devices, a fusible element may be utilized. Usually an assembly, which includes the fusible element, prevents movement of the arcing rod by a stored energy mechanism, often a spring. Melting of the fusible element in response to an overcurrent flowing through the device permits the spring to effect the above-described movement of the arcing rod. See for example, commonly assigned U.S. Pat. Nos. 4,103,270 and 4,075,755, and commonly assigned U.S. patent applications Ser. No. 909,144, filed May 24, 1978, and Ser. No. 741,027, filed Nov. 11, 1976, all incorporated by reference hereinto. Recently developed fuse-like devices include electronic means for sensing current conditions within the circuit. Should an overcurrent be sensed, an appropriate signal is sent to a power cartridge or similar facility for ignition thereof. Ignition of the power cartridge operates a piston-cylinder arrangement to move the arcing rod. Examples of such recently developed devices may be found in commonly assigned U.S. patent applications, Ser. No. 909,145 and Ser. No. 909,146 both filed May 24, 1978 and incorporated by reference hereinto. Circuit switchers and similar devices rely on electronic or electrical sensing to provide a trigger signal to an electromechanical operator. Operation of the operator effects movement of the moving contact within the circuit switcher. Circuit breakers similarly often include electronic or thermal elements which sense overcurrents to operate electrical or electro-mechanical apparatus to ultimately effect movement of the moving contact.

As noted above, extreme overcurrents in excess of the current interrupting rating of prior art circuit interrupting devices may occur. If the device is called on to interrupt such currents, it may fail in that task. Should such happen, the circuit must ultimately be protected by upstream protective devices with which the circuit interrupting device is coordinated. However, failure of the circuit interrupting device, even for a very short time, to perform its interrupting task may ultimately lead to destruction of, or damage to, the circuit including the device itself and electrical apparatus and structures in its vicinity.

Accordingly, it is an object of the present invention to permit circuit interrupting devices to operate normally when they interrupt currents within their current interrupting rating but to prevent their operation during the occurrence of overcurrents which exceed that rating, relying solely on upstream protective devices to interrupt the circuit. In this way, the circuit interrupting device is not subjected to a violent failure and portions thereof may be subsequently reused. Moreover, the risk of damage to the circuit and to structures or electrical apparatus in the vicinity of the circuit interrupting device is minimized.

The present invention represents a departure from the circuit interrupting device depicted in U.S. Pat. No. 2,871,415. In that device an overcenter toggle mechanism operates separable contacts. The device is provided with a first operating solenoid having both an armature connected to one lever of the toggle mechanism and trip and close windings which are suitably energized to effect either separation or closing of the contacts. A second solenoid is provided which has an armature and a holding winding. The holding winding is connected in electrical series with the contacts, and the armature of the second solenoid is adjustably connected to the armature of the first solenoid so as to restrain and prevent tripping of the interrupting device at predetermined different maximum values of current.

The present invention relates to a mechanism, the end result of which is similar to the device of the U.S. Pat. No. 2,871,415 but which is simpler to use, less expensive and more positive in operation.

SUMMARY OF THE INVENTION

The present invention relates to a mechanism which prevents operation of a circuit interrupting device during the occurrence of overcurrents in excess of its interrupting rating. The type of circuit interrupting device with which the present invention is usable generally includes an insulative housing having circuit-connectable opposed terminals thereon. Within the housing is contained a movable contact or arcing rod which is electrically connected to one terminal. Also included within the housing is a stationary contact electrically connected to the other terminal. The arcing rod is movable away from the stationary contact to elongate an arc formed therebetween in an arc-extinguishing environment. Such environment may include a solid, ablative material which evolves cooling, turbulent, deionizing gases due to interaction of the arc therewith or a dielectric fluid, such as $SF_6$ gas, which achieves the same function. The circuit interrupting device also includes means responsive to an overcurrent in the circuit for moving the arcing rod away from the contact.

The improved mechanism for preventing operation of the circuit interrupting device in the event of excessive overcurrents includes a surface feature such as a shoulder, on the arcing rod. A facility responsive to an overcurrent in excess of a predetermined magnitude (generally the current interrupting rating of the device) engages the surface feature to prevent arcing rod movement until the current does not exceed the device's rating. In preferred embodiments, the engaging facility includes one or more movable bodies such as ferromagnetic yokes which are positioned normally adjacent, but out of engagement with, the shoulder. The body is so arranged that its movement toward the arcing rod effects engagement thereof with the surface feature. The body is maintained in its normal position by facilities, typically a spring or the like, until the current through the arcing rod generates sufficient flux to move the body out of its normal position and into engagement with the surface feature. In specific embodiments, the shoulder or other surface feature is defined by a depression or slot formed in the arcing rod. One or more latches or ferromagnetic yokes normally surround the depression or slot on either side of the arcing rod. The yokes or latches are held away from the shoulder by one or more springs to define a gap. The normal proximity of the yokes or latches to the arcing rod, the width of the gap, and the strength of the springs are so related that (a) current through the arcing rod generates flux in the gap proportional to the current and (b) movement of the yokes or latches is prevented until an extreme overcurrent occurs which generates sufficient flux in the gap to overcome the spring force causing movement of the yokes or latches toward the arcing rod and into the depression or slot to prevent arcing rod movement. In yet another preferred embodiment, when the yokes or latches engage the arcing rod's surface feature to prevent its movement, the gap is fully closed and the yokes or latches touch. Accordingly, as the excessive overcurrent decays, the yokes or latches are not pushed back apart by the springs until the current through the circuit interrupting device drops essentially to zero. This decay to zero of the overcurrent is effected by upstream protective devices, such as circuit breakers, which are relied on to interrupt the excessive overcurrent.

The operation of the mechanism which prevents operation of the circuit interrupting device in the event of excessive overcurrents prevents that device from attempting to interrupt currents in excess of its current interrupting rating. Violent damage to the device and to other parts of the electrical circuit into which it is connected, is thereby prevented.

DETAILED DESCRIPTION OF THE INVENTION

Figure 1:
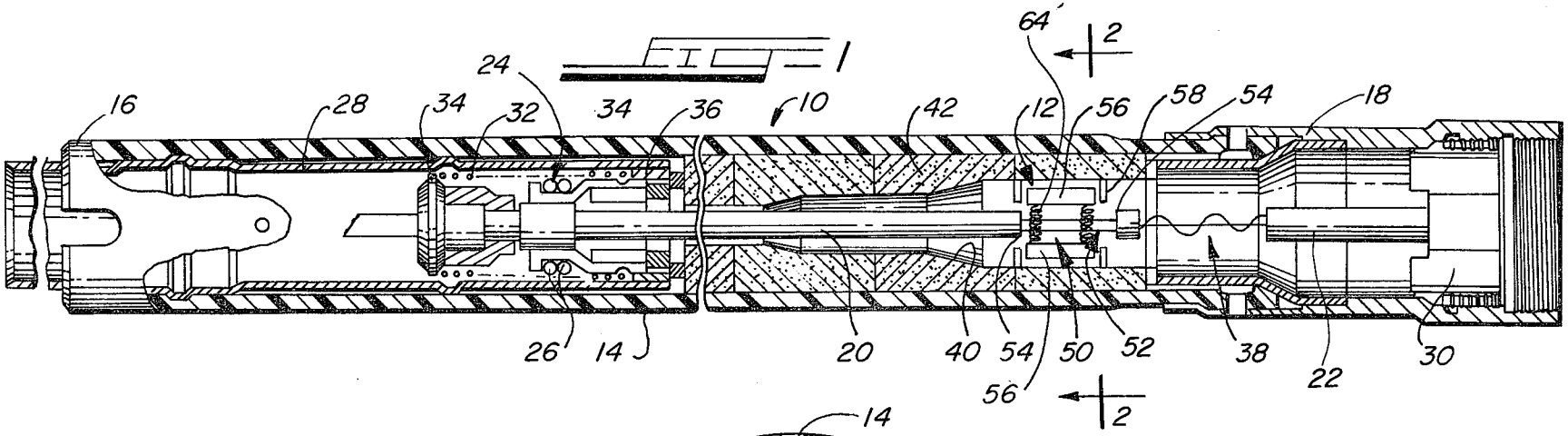
FIG. 1 is a side, partially-sectioned view of a fuse or a fuse-like device which includes one embodiment of the mechanism of the present invention which prevents operation of the fuse in the event of the occurrence of extreme overcurrents.

Referring first to FIG. 1, there is shown a circuit interrupting device 10 which takes the form of a fuse. It is to be understood that the circuit interrupting device 10 may take other forms, such as the fuse-like devices of the '144, '145 and '146 patent applications referred to above, and also need not necessarily be a fuse or a fuse-like device.

Included within the fuse 10 is a mechanism 12 in accordance with the principles of the present invention which prevents operation of the fuse 10 in the event of excessive overcurrents therethrough.

The fuse 10 includes an elongated insulative housing 14 which carries at either end thereof opposed conductive end ferrules 16 and 18. The housing 14 may be any convenient configuration, including one having leakage-distance-increasing skirts thereon (not shown), and may be made of any insulative material such as porcelain, cycloalphatic epoxy resin or a glass-fiber-epoxy combination. The end ferrules 16 and 18 are connectable to opposed points of a circuit (not shown) into which the fuse 10 is connectable for protection thereof.

The fuse 10 includes a movable contact or arcing rod 20 and a stationary contact 22. The arcing rod 20 is surrounded and continuously engaged by a sliding contact structure such as a tulip contact 24 spring biased into contact with the arcing rod 20 by a garter spring arrangement 26. The tulip contact 24 is in turn electrically connected to a conductive metal tube 28 contained within the housing 14 which is electrically connected to the end ferrule 16. Thus, the arcing rod 20 is in continuous electrical contact with the end ferrule 16.

The stationary contact 22 is maintained in constant electrical contact with the end ferrule 18 via a conductive bridge structure 30.

The compressed spring 32 acts between a contact button assembly 34 attached to one end of the arcing rod and a stationary member 36 adjacent and attached to a portion of the tulip contact 24. The spring 32 biases the arcing rod 20 for movement away from the stationary contact 22.

Movement of the arcing rod 20 is normally restrained by a fusible element 38 (or by a fusible-element-strain-wire combination also numbered 38) which is normally connected between the arcing rod 20 and the stationary contact 22. Should an overcurrent occur in the circuit, opposed points of which are connected to the end ferrules 16 and 18, the fusible element 38 (and the strain wire if used) melts or fuses, permitting the spring 32 to move the arcing rod 20 away from the stationary contact 22. The melting or fusing of the fusible element 28 is accompanied by the formation of an arc between the stationary contact 22 and the arcing rod 20. As the arcing rod 20 moves, the arc is elongated through a bore 40 formed in a body of an ablative, arc-extinguishing material 42 which may be boric acid, horn fiber, Delrin, Nylon, Teflon, Lucite, or the like. Interaction of the arc with the arc-extinguishing material 42 generates a large quantities of cooling, turbulent, dionizing gases. The generation of such gases and the elongation of the arc effect extinguishment thereof at a subsequent current zero and interruption of the circuit.

Details of circuit interruption devices 10 which use compressed springs but which take forms varying somewhat from the fuse depicted in FIG. 1 may be found in the '270 and '755 patents and the '144 and '027 applications noted earlier. Also, devices 10 may be used in which an arc-extinguishing fluid, such as $SF_6$ gas, is present therewithin without evolution thereof from an ablative material. Further, in all of the devices 10 with which the mechanism 12 of the present invention is usable, the spring 32 may be replaced by a power cartridge or the like which acts upon a piston-cylinder arrangement to cause movement of the arcing rod 20. This type of device 10 is more specifically escribed in the '145 and '146 applications, noted above.

For purposes of the present invention, the only necessary element of the circuit interrupting device 10 is a movable contact, such as the arcing rod 20, which elongates an arc during circuit interruption by movement thereof away from a stationary contact 22.

Figure 2:
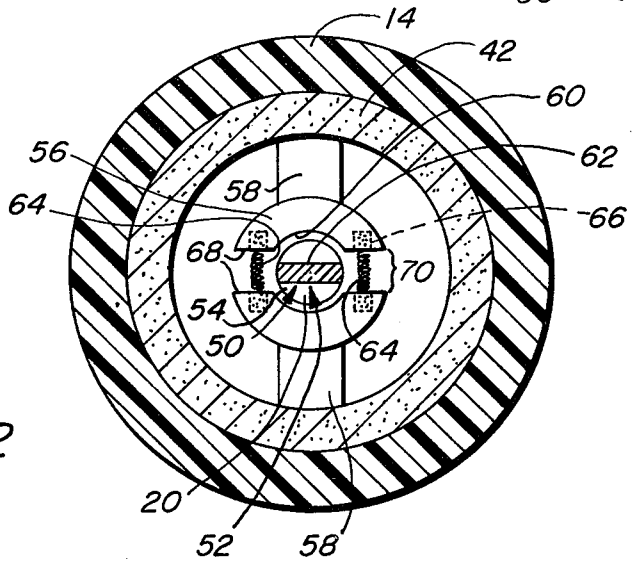
FIG. 2 is a sectional view through the fuse of FIG. 1 along line 2—2 thereof showing in detail one embodiment of the mechanism of the present invention.

Turning now to FIGS. 1 and 2, the mechanism 12 according to the present invention includes a surface feature 50 formed in the arcing rod 20 near the end thereof at which the arc forms during operation of the device 10, although the surface feature 50 may be located elsewhere. The surface feature 50 may comprise a depression or groove 52 formed in the arcing rod 20 to define shoulders 54 at either end thereof. It should be obvious that the surface feature 50 need not take the form of the depression 52 but may rather comprise a protrusion or the like on the arcing rod 20.

Mounted on either side of the depression 52 may be a pair of similar ferromagnetic bodies or yokes 56. The yokes 56 are mounted for movement toward and away from the depression 52 by means of appropriate guides, shown only generally at 58, attached to the inside of the bore 40. As best seen in FIG. 2, the yokes 57 have an inner surface 60 which may approach the bottom 62 of the depression 52 without interference. The length of the yokes 56 is slightly shorter than the length of the depression 52. Should the yokes 56 be moved sufficiently inwardly to contact or closely approach the bottom 62 of the depression 52, the ends of the yokes 56 engage and abut the right-hand shoulders 54 to prevent the arcing rod 20 from moving.

The yokes 56 may be normally held apart by one or more springs 64. The springs may be mounted to the yokes 56 by being attached to the bottom of counter bores 66 formed therein. Preferably the counter bores 66 are sufficiently deep so that when the springs 64 are compressed, movement of the yokes 56 together may be achieved so that pole faces 68 thereof are in contact. Also, the dimensions of the depression 52 and of the yokes 56 is such that when the pole faces 68 of the opposed yokes 56 contact, the yokes 56 engage the peripheral shoulders 54 to prevent movement of the arcing rod 20.

As best seen in FIG. 2, a gap 70 is normally defined between the pole faces 68 of the yokes 56 when the yokes 56 are in their normal position. Such normal position is maintained by the force of the springs 64. As long as the yokes 56 are held in their normal position by the springs 64, movement of the arcing rod 20 by the spring 32 may be effected.

The size of the yokes 56, the ferromagnetic properties thereof, the width of the gap 70, and the force of the springs 64 are all selected and/or adjusted so that, depending on the current interrupting rating of the fuse 10, should the fuse 10 be called on to interrupt an overcurrent within its rating, no or little movement of the yokes 56 takes place and normal operation of the fuse 10 occurs. Should an overcurrent in excess of the current interrupting rating of the fuse 10 occur, all of these parameters are so adjusted that prior to substantial movement of the arcing rod 20, sufficient flux is generated in the gap 70 to cause movement of the yokes 56 toward each other against the action of the springs 64. Such movement continues until the pole faces 68 of the yokes 56 abut and the yokes 56 engage the right-hand shoulders 54 to prevent movement of the arcing rod 20. The flux generated in the gap 70 is due to electro-magnetic coupling between the yokes 56 and the electromagnetic field generated about the arcing rod 20 due to the passage of the excessive over-current therethrough. The difference in length of the yokes 56 and the depression 52, ensures that the yokes 56 have time to engage the shoulders 54 before they move therepast.

With the pole faces 68 now in abutment and movement of the arcing rod 20 prevented, the excessive overcurrent is interrupted and the circuit is opened by an upstream protective device such as a circuit breaker. Subsequently the current through the device 10 begins to decay toward zero. The yokes 56 remain in the position whereat they engage the peripheral shoulders 40 until this current decays to near zero. The reason for this is that when the pole faces 68 abut, close magnetic coupling is achieved, requiring that a very low current through the arcing rod 20 be present before the force of the springs 64 is capable of moving the yokes 56 back to their normal positions. Thus, arcing rod 20 movement under the influence of the spring 32 occurs only when the current level through the device 10 is very low if not zero, thereby preventing any cataclysmic failure thereof. If the pole faces 68 do not engage, the yokes 56 move back to their normal positions when the current through the arcing rod 20 has a value larger than zero but less than the maximum interrupting rating of the fuse 10.

Figures 3, 4, 5:
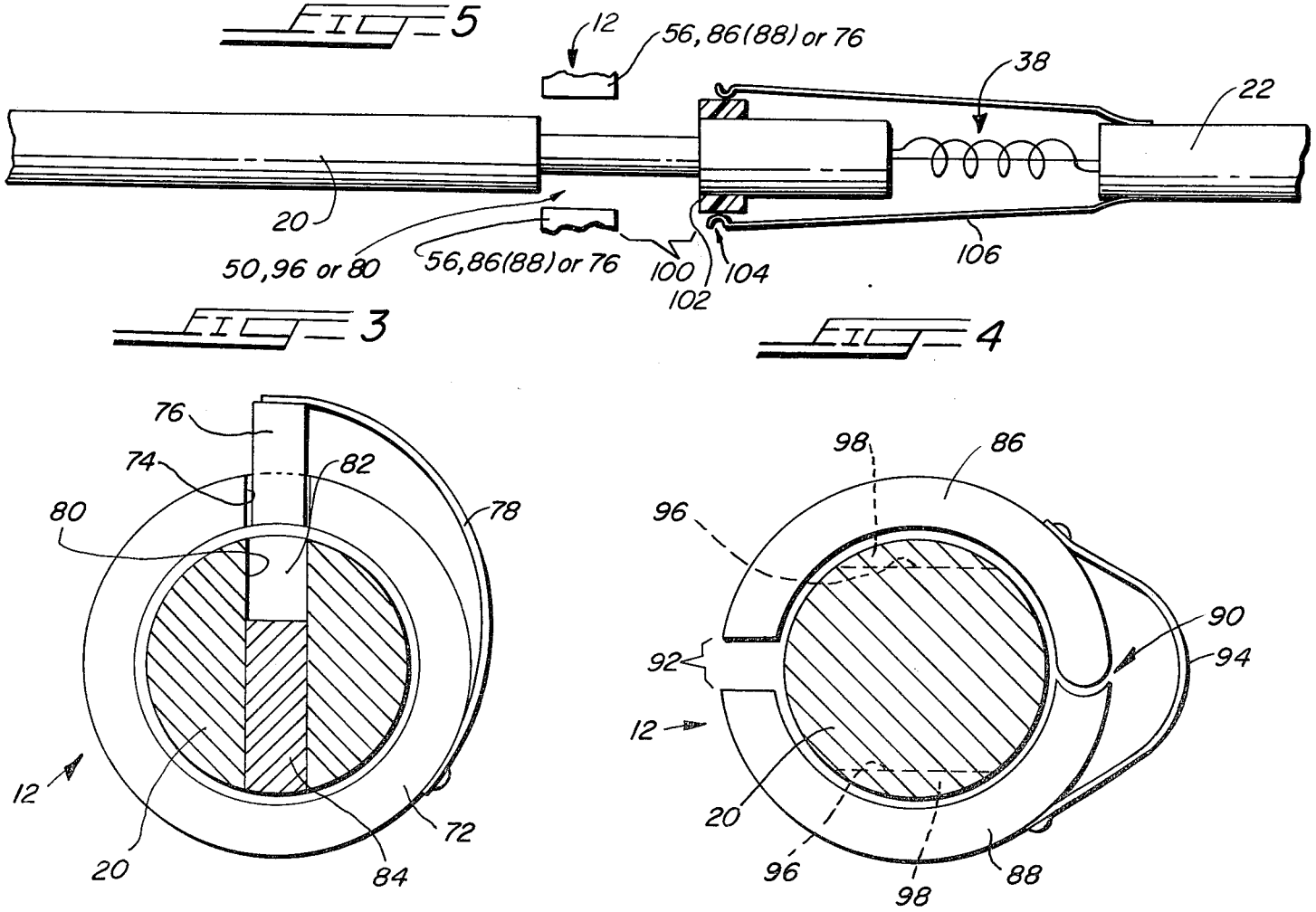
FIGS. 3 and 4 are views similar in aspect to FIG. 2 which show alternative embodiments of the mechanism of the present invention.
FIG. 5 is a view similar in aspect to FIG. 1 which shows another alternative embodiment of the mechanism of the present invention.

FIGS. 3 and 4 are variant mechanism 12 functionally similar to, but structurally different from, that of FIGS. 1 and 2. To the extent possible the same reference numerals are used in FIGS. 3 and 4 as in FIGS. 1 and 2. Most of the elements of the fuse 10 are not shown in FIGS. 3 and 4, although the aspects of these Figures is generally the same as that of FIG. 2, that is, along line 2—2 of FIG. 1.

In FIG. 3, the mechanism 12 includes a stationary yoke 72 surrounding the arcing rod 20. The yoke 72 includes a passage 74 formed therethrough. Freely slidable in the passage 74 is a ferromagnetic latch 76 normally held in the position shown in FIG. 3 by a leaf spring 78 attached between the yoke 72 and the latch 76. The passage 74 is aligned with a slot 80 formed in the arcing rod 20 into which slot 80 the latch 76 may move. The slot 80 defines a shoulder 82 engageable by the latch 76 to prevent movement of the arcing rod 20. At the bottom of the slot 80 may be a ferromagnetic insert 84.

The size, shape and materials of, and normal separation between, the elements 20 and 72–84 are all selected or adjusted so that the mechanism 12 of FIG. 3 operates similar to that of FIGS. 1 and 2. When an excessive current flows through the arcing rod 20, the magnetic coupling between the yoke 72, the insert 84 and the latch 76, pulls the latch 76 into the slot 80 to engage the shoulder 82. The use of the insert 84 enhances this magnetic coupling, as the arcing rod 20 is usually made of a non-ferromagnetic material, such as copper.

In FIG. 4, the mechanism 12 includes a pair of yokes 86 and 88 hinged together as generally shown at 90 for pivoting movement. Opposite the hinge 90, the yokes 86 and 88, which surround the arcing rod 20, are separated by a gap 92. A leaf spring 94 attached between the yokes 86 and 88 holds them in the normal positions shown in FIG. 4. Portions of the arcing rod 20 are machined or formed to define depressions 96 into which the yokes 86 and 88 may move to engage shoulders 98 thereof to prevent movement of the arcing rod 20. The mechanism 12 operates similar to that shown in FIG. 3, due to flux in the gap 92. If the yokes 86 and 88 contact each other to close the gap 92, the mechanism 12 of FIG. 4 releases the arcing rod 20 for movement when the current in the arcing rod 20 decays to near zero as described with reference to FIG. 1 and 2.

The mechanisms 12 of FIGS. 3 and 4 are somewhat faster acting than that of FIGS. 1 and 2. This ensures that the latch 76 or yokes 86 and 88 enter the slot 80 or the depressions 96 before that arcing rod 20 moves so much that such entry cannot be achieved.

In FIG. 5, the mechanism 12 is only generally depicted, as it may take any of the forms shown in FIGS. 1–4. The yokes 56,86 or 88, or the latch 76, are substantially shorter than the depressions 50 or 96, or the slot 80, along the length of the arcing rod 20 to efine a lost motion gap 100. This gap 100 permits the fusible element 38 to melt and the arcing rod 20 to begin moving before the mechanism 12 is required to react to severe overcurrents and prevent movement of the arcing rod 20. Assuming that the arcing rod 20 moves before the mechanism 12 is able to react to the overcurrent, the gap 100 permits limited movement of the arcing rod 20 until such movement is arrested. In the event of such operation of the device 10, the fusible element 38 will have melted. The arcing rod 20 cannot move, but if appropriate steps are not taken, an arc will have formed between the arcing rod 20 and the stationary contact 22. Even though the upstream breaker may interrupt the circuit in a few cycles of the overcurrent, arcing within the device 10 for these few cycles may be undersirable. FIG. 5, therefore, represents an embodiment of the present invention which permits both melting of the fusible element 38 and some small amount of movement of the arcing rod 20, but also prevents arcing in the device 10 following operation of the mechanism 12. Specifically, forward of the depression 50 or 96, or the slot 80, a layer 102 of an electrically insulative material is applied to the arcing rod 20. Contacting the layer 102 are spring contacts 104 connected to the stationary contact 22 by main contact bodies 106. The main contact bodies 106 usually carry no current whether the fusible element 38 is present or not. In the normal condition of the device 10, the fusible element 38 is intact; the current through the device 10 flows through the stationary contact 22, the fusible element 38 and the arcing rod 20 which together form a relatively low resistance path. When the arc replaces the fusible element 38 in this path following melting of the fusible element 38, the path's resistance remains lower than that of the layer/-contact 102/104 interface. However, following movement of the arcing rod 20 up to a distance equal to the length of the gap 100, by which time the mechanism 12 prevents further movement of the arcng rod 20, the spring contacts 104 ride off the layer 102 and contact the arcing rod 20 to electrically connect it to the stationary contact 22. This prevents the occurrence of arcing within the device 10, until the current through the arcing rod 20 is within the current interrupting rating of the device 10, at which time the arcing rod 20 is released for movement as described above.

In the embodiments of FIGS. 2 and 4, initial gaps 70 and 92 are respectively, defined between yoke pairs 56,56 and 86,88. In FIG. 3 a gap is defined between the latch 76 and the insert 84. After any relative movement of the yoke pairs 56,56 or 86,88 or of the latch 76 and the insert 84 which decreases these gaps, the magnetic reluctance thereof are reduced. This reduction allows flux in the gaps to increase to accelerate and augment further decreases of the gaps and of the time it takes for the movement of the arcing rod 20 to be arrested.

While it is preferred that the mechanisms 12 of the present invention prevent operation of a fuse 10 or other circuit interrupting device when current therethrough exceeds the current interrupting rating of the device, any predetermined current level may be chosen. For example, operation of the device 10 at any current level, including those which can be interrupted by the device 10, may be prevented by the mechanism 12, if so desired, for coordination with other protective devices or for other reasons. This current level may be defined as a "pre-determined current level" or a "selected maximum current interrupting level."

The specific structures herein disclosed may be modified or substituted for without departing from the spirit of the present invention. For example, the yoke pairs 56,56 and 86,88 could be replaced by a ferromagnetic spring, adjacent to or surrounding the arcing rod 20, which is pulled into the grooves 52 or 96 by magnetic forces. The spring may be a leaf spring, garter spring or the like. Further, the yoke pairs 56,56 and 86,88 may be constructed so as to continually engage the grooves 52 and 96 under a light spring force. If the predetermined current lever is not exceeded, the spring 32 (or other facility for moving the arcing rod 20) is able to move the arcing rod 20. If the predetermined current level is exceeded, the arcing rod 20 is held by forces in excess of the light spring force.

What is claimed is:

1. In a high-voltage device of the type wherein a movable contact is moved away from a stationary contact to form a gap therebetween to interrupt current through the device; a mechanism for limiting movement of the movable contact when, and as long as, the current exceeds a predetermined magnitude, which mechanism comprises:

an engageable feature on the movable contact, and means responsive to the electromagnetic field produced about the movable contact by the flow through the contacts of a current exceeding the predetermined magnitude for engaging the feature to limit movement of the movable contact.

2. In a high-voltage circuit interrupting device of the type wherein, upon the occurrence of an overcurrent therethrough, a movable contact is moved away from a stationary contact to elongate an arc formed therebetween in an arc-extinguishing environment; a mechanism for preventing movement of the movable contact when, and as long as, the overcurrent exceeds the current interrupting rating of the device, which mechanism comprises:

an engageable feature on the movable contact, and means responsive to the electromagnetic field produced about the movable contact by the flow through the contacts of an overcurrent exceeding the current interrupting rating of the device for engaging the feature to prevent movement of the movable contact.

3. The mechanism of claim 1, which further comprises:

means for maintaining the engaging means out of engagement with the feature unless the overcurrent exceeds the current interrupting rating of the device.

4. The mechanism of claim 3, wherein:

the engaging means comprises a ferromagnetic member movable toward and away from the movable contact, the ferromagnetic member being moved toward the movable contact by the electromagnetic field thereabout.

5. The mechanism of claim 4, wherein:

the maintaining means comprises a resilient biasing member connected to the ferromagnetic member, the bias of the resilient member maintaining the ferromagnetic member out of engagement with the feature until the electromagnetic field is sufficiently strong to move the ferromagnetic member against the bias.

6. The mechanism of claim 5, wherein:

the movable contact is an elongated arcing rod movable along its main axis, and the feature is a shoulder on the arcing rod.

7. The mechanism of claim 6, wherein:

the engaging means further comprises a pair of yokes surrounding the arcing rod and mounted for movement toward each other to capture the shoulder therebetween, and the resilient biasing member comprises a spring connected between the yokes for holding the yokes apart to define a flux gap therebetween.

8. The mechanism of claim 6, wherein:

the engaging means further comprises a pair of yokes surrounding the arcing rod and connected together by a hinge for pivoting movement toward each other to capture the shoulder therebetween, and the resilient biasing member comprises a spring connected between the yokes for holding the yokes apart to define a flux gap therebetween opposite the hinge.

9. The mechanisms of claim 7 or 8, wherein:

each yoke has a pole face between which the flux gap is defined, the pole faces contacting when the shoulder is engaged so that the spring is unable to move the yokes away from the shoulder until the current in the arcing rod is substantially zero.

10. The mechanisms of claim 7 or 8, wherein:

each yoke has a pole face between which the flux gap is defined, the pole faces moving toward each other to engage the shoulder, the spring being unable to move the yokes away from the shoulder until the current in the arcing rod is within the interrupting rating of the device.

11. The mechanism of claim 10, wherein:

the shoulder is defined by a depression formed in the arcing rod, and the yokes have a length along the arcing rod less than the length of the depression therealong.

12. The mechanism of claim 6, which further comprises a ferromagnetic insert in the arcing rod adjacent the shoulder; and wherein the engaging means comprises a stationary yoke surrounding the arcing rod, the yoke being broken to define a flux gap, and a ferromagnetic latch movable in the flux gap toward the arcing rod and the insert to engage the shoulder; and the resilient biasing means comprises a spring connected between the yoke and the latch for holding the latch away from the shoulder to define a gap between the latch and the insert.

13. The mechanism of claim 12 wherein the shoulder is defined by a depression formed in the arcing rod, and the latch has a length along the arcing rod less than the length of the depression therealong.

14. The mechanism of claim 11, wherein the yokes are positioned away from the shoulder along the arcing rod in the direction of arcing rod movement to define a lost motion gap between the yokes and the shoulder, the arcing rod being movable a distance equal to the width of the lost motion gap before its movement is prevented by the yokes.

15. The mechanism of claim 14, which further comprises means for metallically interconnecting the arcing rod and the stationary contact after the arcing rod has moved the width of the lost motion gap thereby terminating the arc.

16. The mechanism of claim 13, wherein the latch is positioned away from the shoulder along the arcing rod in the direction of arcing rod movement to define a lost motion gap between the latch and the shoulder, the arcing rod being movable a distance equal to the width of the lost motion gap before its movement is prevented by the latch.

17. The mechanism of claim 16, which further comprises means for metallically interconnecting the arcing rod and the stationary contact after the arcing rod has moved the width of the lost motion gap thereby terminating the arc.

18. An improved high voltage circuit interrupting device of the type having a housing, terminals on the housing connectable to opposed points of a circuit, a fusible element attached between one end of a movable arcing rod continuously electrically connected to one of the terminals and a stationary contact continuously electrically connected to the other terminal, means for moving the arcing rod after the fusible element is melted by an overcurrent in the circuit to elongate an arc formed between the arcing rod and the stationary contact, and means for extinguishing the arc; wherein the improvement comprises:

a surface feature on the arcing rod; and means responsive to a current in excess of a predetermined magnitude for engaging the surface feature to restrain movement of the arcing rod until the current in the circuit drops below the predetermined magnitude.

19. The interrupting device of claim 18, wherein:

the engaging means comprises a pair of separated ferromagnetic yokes surrounding the arcing rod and mounted for movement toward each other to capture the surface feature therebetween; and means for maintaining the yokes separated until the current through the arcing rod establishes sufficient flux between the yokes to move them together to capture the surface feature.

20. An improved circuit interrupting device of the type having an insulative housing with circuit-connectable, opposed terminals thereon; an arcing rod continuously electrically connected to one terminal, which is movable away from a stationary contact cntinuously electrically connected to the other terminal, to elongate an arc formed therebetween in an arc-extinguishing medium; and means responsive to an overcurrent in the circuit for moving the arcing rod away from the stationary contact; wherein the improvement comprises:

a detent feature on the arcing rod; and means responsive to the electromagnetic field produced about the arcing rod by an overcurrent in excess of a predetermined magnitude for engaging the feature to limit arcing rod movement until the current drops below the predetermined magnitude.

21. The device of claim 20, wherein:

the predetermined magnitude of the current is the current interrupting rating of the device.

22. The device of claim 20, wherein:

the engaging means comprises a movable ferromagnetic body positioned normally adjacent but out of engagement with the shoulder, movement of the body toward the arcing rod effecting engagement thereof with the shoulder; and means for maintaining the body in its normal position until current through the arcing rod establishes sufficient flux to move the body out of its normal position.

23. The device of claim 22, wherein:

the maintaining means is a spring connected to the body, the force of the spring being overcome only when sufficient flux is established by the current to move the body against the action of the spring and into engagement with the shoulder.

24. The device of claim 20, wherein:

the engaging means comprises a pair of opposed ferromagnetic yokes about the arcing rod movable toward each other to capture the arcing rod therebetween and to engage the shoulder when the arcing rod is so captured; and means for maintaining the yokes apart and until the current through the arcing rod establishes sufficient flux to move the yokes toward each other to capture the yoke and prevent arcing rod movement.

25. The device of claim 24, wherein:

the maintaining means includes a spring between the yokes, a gap being defined between the separated yokes, the yokes and the gap being so related to the arcing rod that current therethrough establishes flux in the gap proportional to the current, the width of the gap and the force of the spring being such as to prevent movement of the yokes when the current is less than the predetermined magnitude.

26. The device of claim 25, wherein the gap is fully closed and the yokes touch when the shoulder is captured therebetween so that the force of the spring is unable to move the yokes apart until the current through the arcing rod is substantially zero.

27. The device of claim 26, wherein the shoulder is defined by a peripheral depression in the arcing rod, the yokes being so configured as to be enterable into the depression upon their movement together.

28. In a high-voltage circuit interrupting device of the type wherein a movable contact is moved away from a stationary contact to form a gap therebetween in an arc-extinguishing environment to interrupt current through the device, a mechanism for limiting movement of the movable contact when, and as long as, the current exceeds a predetermined magnitude, which mechanism comprises:

an engageable feature on the movable contact, and means responsive to the electromagnetic field produced about the movable contact by the flow through the contacts of a current exceeding the predetermined magnitude for engaging the feature to limit movement of the movable contact.

29. The mechanism of claim 28, wherein:

the engaging means responds to the electromagnetic field established about the movable contact by the current.

30. The mechanism of claim 29, wherein:

the engaging means comprises a ferromagnetic member urgable toward and away from the movable contact, the ferromagnetic member being urged toward the movable contact by the electromagnetic field thereabout.

* * * * *